US009685140B1

(12) United States Patent
Wilson et al.

(10) Patent No.: US 9,685,140 B1
(45) Date of Patent: Jun. 20, 2017

(54) OPTIMIZED RENDERING OF MULTIMEDIA CONTENT

(75) Inventors: Brett Wilson, Sunnyvale, CA (US); Antoine Labour, Mountain View, CA (US)

(73) Assignee: Google Inc., Mountain View, CA (US)

( * ) Notice: Subject to any disclaimer, the term of this patent is extended or adjusted under 35 U.S.C. 154(b) by 1101 days.

(21) Appl. No.: 13/232,071

(22) Filed: Sep. 14, 2011

Related U.S. Application Data

(60) Provisional application No. 61/384,178, filed on Sep. 17, 2010.

(51) Int. Cl.
*G09G 5/14* (2006.01)

(52) U.S. Cl.
CPC ..... *G09G 5/14* (2013.01); *G09G 2340/125* (2013.01)

(58) Field of Classification Search
None
See application file for complete search history.

(56) References Cited

U.S. PATENT DOCUMENTS 5,590,254 A * 12/1996 Lippincott et al. ..... 345/634
6,353,450 B1 * 3/2002 DeLeeuw ..... 715/768
6,952,217 B1 10/2005 Diard et al.
2008/0120626 A1 * 5/2008 Graffagnino et al. ..... 719/320
2009/0193355 A1 * 7/2009 Tada ..... 715/790
2011/0202424 A1 * 8/2011 Chun et al. ..... 705/26.8

OTHER PUBLICATIONS

Final Office Action dated May 15, 2012 issued in related U.S. Appl. No. 13/245,793.
Non-Final Office Action dated Mar. 1, 2013 issued in related U.S. Appl. No. 13/245,793.

* cited by examiner

*Primary Examiner* — Aaron M Richer
(74) *Attorney, Agent, or Firm* — McDermott Will & Emery LLP

(57) ABSTRACT

Systems, methods and articles of manufacture for optimized rendering of multimedia content as described herein. An embodiment includes identifying one or more content layers for display and promoting the multimedia content layer for display over all layers of the one or more content layers, when no content is to be displayed over the multimedia content layer. Another embodiment includes identifying one or more content layers for display and displaying a bitmap representing a multimedia content layer directly on a display device, when no content is to be displayed over the multimedia content layer.

23 Claims, 6 Drawing Sheets

OPTIMIZED RENDERING OF MULTIMEDIA CONTENT

CROSS-REFERENCE TO RELATED APPLICATION

This patent application claims the benefit of U.S. Provisional Patent Application No. 61/384,178, filed Sep. 17, 2010, entitled "Optimized Rendering Of Multimedia Content," which is incorporated herein by reference in its entirety.

BACKGROUND

Field

Embodiments generally relate to browsers, and particularly to rendering of content in web browsers.

Background Discussion

Browsers are used to access web content or locally stored content. A user can interact with a browser through a user-interface to direct a browser to different content areas. Content areas may contain text, audio, video and other forms of content delivery. Content requested by a user through a browser needs to be rendered for display so that the user can view the content using a display device such as a monitor.

Frequently updated content areas can include video, browser plug-in content or any other multimedia content. When rendering frequently updated content areas on a web page, the frequently updated content areas are rendered over the content (e.g., HTML content) of the web page. This mode of rendering is generally referred to as a "windowed" mode. In the windowed mode, frequently updated content areas (e.g., videos or animations) are rendered with no compositing, i.e., the video and animations do not blend in with web page content. To allow compositing of video and animations with web page content, web page authors use a "windowless" rendering mode. In the windowless rendering mode, video and animations can visually blend with web page content.

Both the windowed mode and the windowless mode have their disadvantages. In particular, the windowed mode is undesirable because it limits design flexibility of a web page author. For example, web page authors cannot overlay pop-up menus above a windowed video. The windowless mode is undesirable because rendering frequently updated content in this mode needs additional copies of the frequently updated content's individual frames to be made. Furthermore, complex animations and high definition video content do not perform well in the windowless mode.

BRIEF SUMMARY

Embodiments relate to optimized rendering of multimedia content. An embodiment includes identifying one or more content layers for display and promoting a multimedia content layer for display over all layers of the one or more content layers, when no content is to be displayed over the multimedia content layer. Another embodiment includes identifying one or more content layers for display and displaying a bitmap representing a multimedia content layer directly on a display device, when no content is to be displayed over the multimedia content layer.

Further embodiments, features, and advantages of the embodiments, as well as the structure and operation of the various embodiments are described in detail below with reference to accompanying drawings.

BRIEF DESCRIPTION OF THE DRAWINGS

Embodiments are described with reference to the accompanying drawings. In the drawings, like reference numbers may indicate identical or functionally similar elements. The drawing in which an element first appears is generally indicated by the left-most digit in the corresponding reference number.

DETAILED DESCRIPTION

Embodiments relate to optimized rendering of multimedia content. An embodiment includes identifying one or more content layers for display and promoting a multimedia content layer(s) for display over all layers of the one or more content layers, when no content is to be displayed over the multimedia content layer. Because the multimedia content layer is promoted for display over all other content layers (e.g., those that include less frequently updated HTML content), content layers below the multimedia content layer are able to render and display quickly with fewer rendering artifacts. Another embodiment includes identifying one or more content layers for display and displaying a bitmap representing a multimedia content layer directly on a display device, when no content is to be displayed over the multimedia content layer. Because the multimedia content layer bitmap can be displayed directly on the display, the remaining content (e.g., less frequently updated HTML content) need not be composited and re-painted along with the multimedia content layer when displaying a web page. Such direct display saves time and processing resources.

In this way, embodiments enable faster rendering of multimedia content and any other frequently updated content while efficiently utilizing processing resources.

While the present embodiments are described herein with reference to illustrative applications, it should be understood that the embodiments are not limited thereto. Those skilled in the art with access to the teachings provided herein will recognize additional modifications, applications, and embodiments within the scope thereof and additional fields in which the embodiments would be of significant utility.

The term "content area" used herein refers to an area of a user interface display that can display content addressed by an address, such as, a uniform resource locator (URL) or a file name. As an illustrative example, the content displayed in the content area may include, for example, a web page, application, document, video, multimedia content, future utilized content mechanism, or any combination thereof. These examples are illustrative and are not intended to limit the definition.

The term "multimedia content" as used herein refers to any changing or updating content including, but not limited to, video, animation, sound, three-dimensional visualizations, cursors, frequently changing content items, or any combination thereof. These examples are illustrative and are not intended to limit the embodiments.

The term "bitmap" used herein refers to data in a content area that can be rendered for display or modified and then rendered for display. As an example, a bitmap may be a group of one or more pixels representing content. This example is illustrative and not intended to limit the embodiments.

System

Figure 1A:
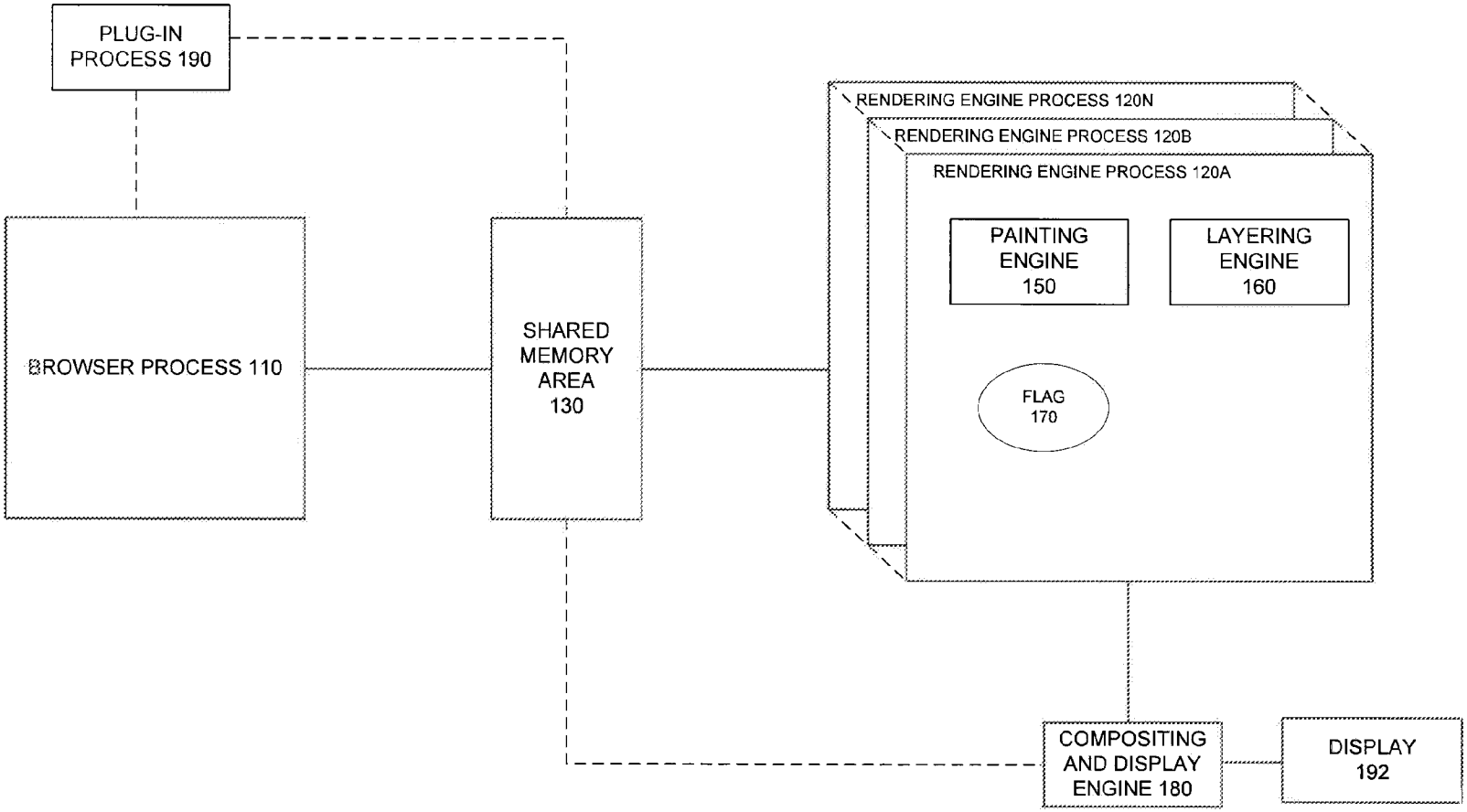
FIG. 1A illustrates a system for optimized rendering of multimedia content, according to an embodiment.

This section describes a system for optimized rendering of multimedia content according to an embodiment with respect to FIG. 1A. FIG. 1A is a diagram of system 100 according to an embodiment.

System 100 may be implemented on any device that can support browsing. Such a device may include, but is not limited to, a device having a processor and memory for executing and storing instructions. Such a device may include software, firmware, and/or hardware. Software may include one or more applications and an operating system. Hardware can include, but is not limited to, a processor, memory and user interface display. Optional input devices, such as a keyboard, a mouse, a touch sensitive screen, joystick, or other interface device may be used.

System 100 may contact a remote server (not shown) and download data to display. In examples, the data may be represented as hypertext markup language, dynamic hypertext markup language, extendable markup language, image data, video or sound and any multimedia content. In another example, system 100 may download and execute scripts according to the AJAX (Asynchronous JavaScript and XML) framework. The AJAX framework may asynchronously transmit and receive data from a server to system 100 to update a content area without reloading the content area.

In an embodiment, system 100 may be implemented as a multi-process browser. A system for providing multi-process browser architecture may include at least one rendering engine process for each browsing instance that renders a content area and at least one browser process that communicates with one or more rendering engine processes. A multi-process browser architecture is described in detail in U.S. patent application Ser. No. 12/464,594, entitled "Multi-Process Browser Architecture," which is incorporated by reference in its entirety.

System 100 includes browser process 110 coupled to one or a plurality of rendering engine processes 120A-N through shared memory area 130. Browser process 110 can communicate with one or more web servers (not shown) over one or more networks, such as the Internet. Browser process 110 can further communicate with an input device (not shown) to allow a user to input data, to input commands, or to provide other control information to browser process 110. Rendering engine process(es) 120A-N can render data for display at a client device running browser process 110. Browser process 110 can also communicate with plug-in process 190. Such a plug-in process 190 (e.g., a multimedia content player) may be instantiated when a user directs a browser (that includes browser process 110) to a web page that is configured to load multimedia content. Browser process 110 then instantiates plug-in process 190 to render the multimedia content.

Browser process 110 and rendering engine process(es) 120A-N may communicate through shared memory area 130. Shared memory area 130 may be any form of volatile or non-volatile memory that can be used to store data.

As shown in FIG. 1A, rendering engine process 120A-N may each include painting engine 150, layering engine 160 and flag 170. Rendering engine process 120A-N may maintain, set, reset or modify any number of flags other than flag 170. In addition system 100 includes, compositing and display engine 180 coupled to rendering engine processes 120A-N and shared memory 130. In another embodiment, a separate compositing and display engine 180 can exist for each rendering engine process 120A-N.

System 100 can be configured to work with one or more content layers of a web page that can be displayed on display 192 by system 100. As an example, such content layers can be specified using a 'z-index' attribute used by cascading style sheets (CSS) in conjunction with hyper text mark-up language HTML defining the web page. Positioning of content in CSS (or any HTML configured to work with content layers) occurs in three dimensions. The first and the second dimensions are the length and the width of a content area. The third dimension (or the z-axis) is perpendicular to a screen (e.g., display 192), giving the screen a sense of depth. Content layers can be overlapped along the z-axis with "higher", or "closer" elements obscuring elements that are "lower" or "farther away." In this way, web page content can be represented as one or more content layers that overlap each other to display the web page.

Placement of content layers along the 'z-axis' can be controlled by layering engine 160 using the z-index attribute. For example, a content layer 'A' having a z-index value of '0' is placed below a content layer 'B' having a z-index value of '1'. In order to move content layer 'B" over content layer 'A', layering engine 160 changes the z-index of content layer 'B' to '0' and the z-index of content layer to '1', resulting in content layer 'B' being displayed above content layer 'A'. This example is purely illustrative and is not intended to limit the embodiments.

In an embodiment, painting engine 150 is configured to determine when content is to be displayed over (or overlaid) a multimedia content layer in a web page. Layering engine 160 is configured to promote the multimedia content layer for display over all other web page content layers, when layering engine 160 determines that no content is to be displayed over the multimedia content layer. As an example, layering engine 160 is configured to promote the multimedia content layer by modifying the z-index associated with the multimedia content layer. Layering engine 160 then stores the content layers, including any promoted multimedia content layer, in shared memory area 130. Compositing and display engine 180 is configured to composite the stored content layers including the multimedia content layer(s), in the order determined by layering engine 160, for display. The operation of painting engine 150, layering engine 160 and compositing and display engine 180 is discussed further below.

System 100 can also communicate with plug-in process 190. In an embodiment, the multimedia content layer discussed above is rendered by plug-in process 190. In an embodiment, plug-in process 190 (or multimedia content player) may be instantiated when user directs a browser to a web page that is configured to load multimedia content. Browser then instantiates plug-in process 190 to render the multimedia content. For example, if the web page includes interactive content, an interactive player plug-in is instantiated to play the interactive content. Such a plug-in may be instantiated by system 100 within browser process 110 or may be instantiated as a separate 'out-of-process' plug-in.

Painting Engine 150 and Layering Engine 160

As discussed above, painting engine 150 is configured to determine when content is to be displayed over multimedia content layer on a web page. In a non-limiting embodiment, painting engine 150 can determine if content is to be displayed over the multimedia content layer by checking a z-index associated with a content layer and comparing the z-index of the content layer to the z-index of the multimedia content layer. For example, if a content layer 'A' has a z-index of 2 and a multimedia content layer has a z-index of 1, painting engine 150 may determine that a content layer overlaps the multimedia content layer because the content layer 'A' has a higher z-index than the multimedia content layer.

In another embodiment, painting engine 150 can also check the ordering of content in mark-up language (e.g., HTML) defining the web page to determine if a content layer overlaps the multimedia content layer.

In another embodiment, painting engine 150 can determine if a content layer above a multimedia content layer has non-transparent regions (or substantially non-transparent regions) that obscure (i.e., hide from view) the multimedia content layer partially or completely. If no content layer above the multimedia content layer has non-transparent regions (or substantially non-transparent regions) overlapping the multimedia content layer, painting engine 150 may determine that no content is to be displayed over the multimedia content layer that may obscure the multimedia content layer (or one or more regions of the multimedia content layer). In an embodiment, when painting engine 150 determines that content is displayed over the multimedia content layer that obscures the multimedia content layer, painting engine 150 sets flag 170. Then, whenever the multimedia content layer is to be re-painted on display 192, flag 170 is checked. During such a check, if painting engine 150 determines that flag 170 is set, painting engine 150 determines that content is to be displayed over the multimedia content layer and painting engine 150 paints the web page content layers and the multimedia content layer in a back-to-front manner based on their respective z-indices. However, if painting engine 150 determines that flag 170 is not set, painting engine 150 may determine that no content is to be displayed or painted over the multimedia content layer that may obscure the multimedia content layer.

In an embodiment, when no content is to be displayed over the multimedia content layer, layering engine 160 promotes the multimedia content layer over all other layers of the web page's content layers. Because the multimedia content layer is promoted by layering engine 160 over all other content layers, the content layers below the multimedia content layer, are able to render quickly with fewer rendering artifacts. This is because if content is rendered over multimedia content (or any other frequently changing content), it requires additional resources to render, and also makes some types of blending (such as sub-pixel text rendering) difficult for the content rendered over the multimedia content. However, because the multimedia content layer is promoted for display over all other content layers, it allows the remaining page content to render with fewer layers (at least one less multimedia content layer) alleviating such concerns.

In another embodiment, when no content is to be rendered over the multimedia content layer, browser process 110 displays a bitmap representing a multimedia content layer directly on a display 192. Because the multimedia content layer bitmap can be displayed directly on display 192 from shared memory 130, the remaining content in the web page (e.g., less frequently updated HTML content) need not be re-rendered and re-painted along with the multimedia content layer. Furthermore, because embodiments enable direct display of the multimedia content layer bitmap from shared memory 130, an additional bitmap that is a composition of the web page content and the multimedia content layer need not be generated.

In an embodiment, painting engine 150 may check the alpha (or transparency) channel of the multimedia content layer to determine if the multimedia content layer needs to be blended (e.g., blended at pixel level) with other web-page content layers. In an embodiment, when painting engine 150 determines that each pixel in the multimedia content layer is opaque (or substantially opaque), browser process 110 displays a bitmap representing a multimedia content layer directly on a display 192. However, when painting engine 150 determines that each pixel in the multimedia content layer is not opaque and the multimedia content layer is transparent (or partially transparent) in one or more regions, painting engine 150 may blend the pixels of the multimedia content layer with those of other content layers in the web page that are below the multimedia content layer. In a non-limiting embodiment, content layers below the multimedia content layer may be blended together and cached as blended content layers for subsequent blending with the multimedia content layer.

In an embodiment, plug-in process 190 or a web page displaying a multimedia content layer can be configured by system 100 to specify if the multimedia content layer is always displayed on top of all other content layers of the web page. For example, plug-in process 190 or a web page displaying a multimedia content layer can be configured by system 100 to set a flag if the multimedia content layer is always displayed on top of all other content layers of the web page. Painting engine 150 can then check the flag to display a bitmap representing a multimedia content layer directly on a display 192. In another embodiment, layering engine 160 can also check such a flag to promote the multimedia content layer over all other layers of the web page's content layers.

In this way, because plug-in process 190 or a web page displaying a multimedia content layer can be configured by system 100 to specify if the multimedia content layer is always displayed over all other content layers of the web page, painting engine 150 need not check the transparency of the multimedia content layer. Furthermore, in an embodiment, when the flag specifies that the multimedia content layer is always displayed over all other content layers of the web page, layering engine 160 can automatically promote the multimedia content layer over all other layers of the web page's content layers for display. In another embodiment, when the flag specifies that the multimedia content layer is always displayed over all other content layers of the web page, browser process 110 displays a bitmap representing a multimedia content layer directly on a display 192.

In this way, embodiments enable faster rendering of multimedia content and any other frequently updated content while efficiently utilizing processing resources.

In an embodiment, layering engine 160 stores the content layers, that may include a promoted multimedia content layer, into shared memory 130. Compositing and display engine 180 composites the stored content layers, including any promoted multimedia content layer(s) for display on display 192.

In an embodiment, when painting engine 150 determines that a multimedia content layer rendered by plug-in process 190 includes one or more transparent or partially transparent areas, painting engine 150 can cache (or store) regions of content that appear below the transparent (or partially transparent) areas of the multimedia content layer.

In this way, compositing and display engine 180 can quickly display a web page content layer that is located under a transparent or partially transparent layer using such cached regions of content.

Figure 1B:
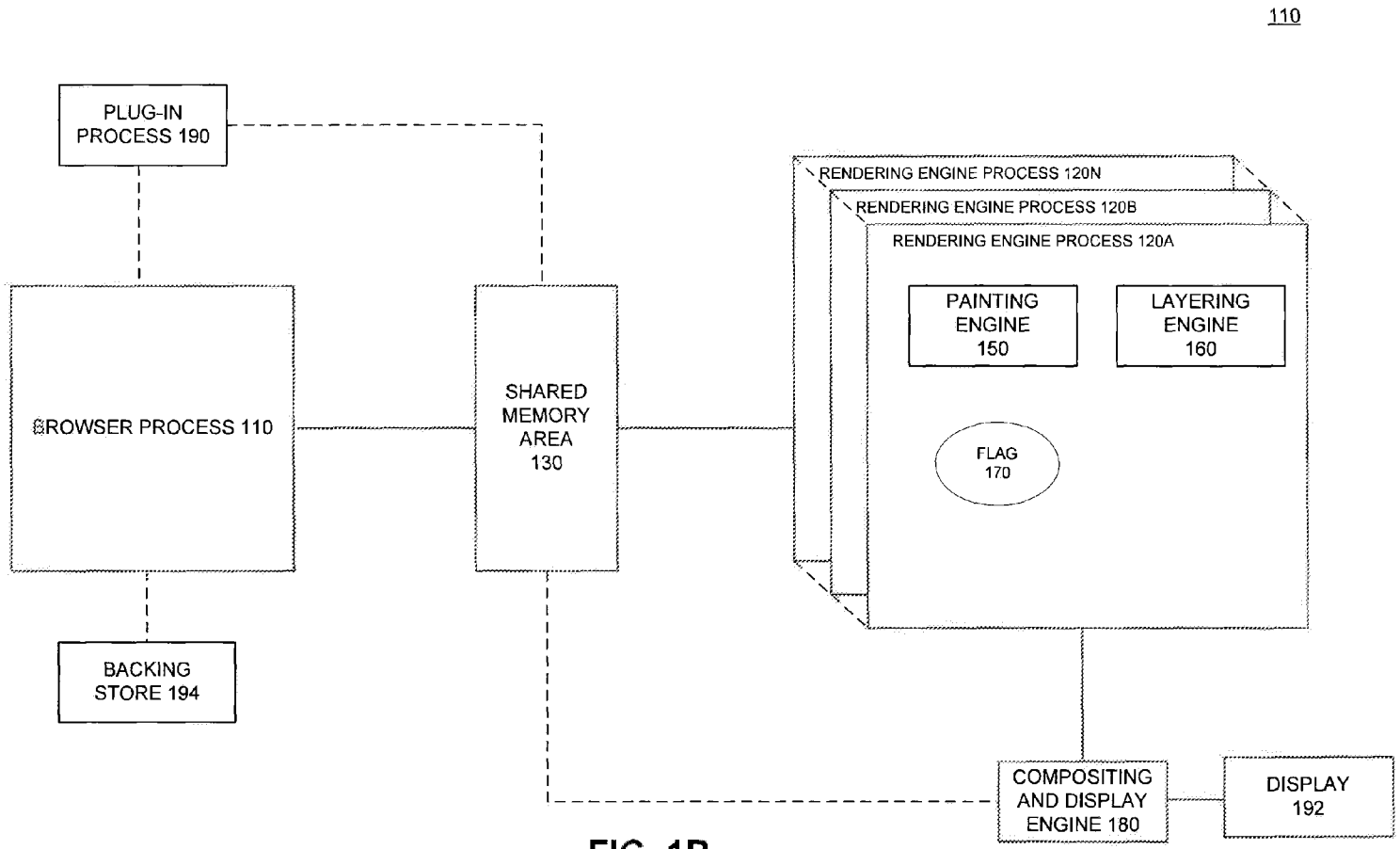
FIG. 1B illustrates a system for optimized rendering of multimedia content, according to another embodiment.

FIG. 1B illustrates system 110 which is another embodiment of system 100 that includes backing store 194. Browser process 110 may communicate with backing store 194. Backing store 194 may be a form of a device dependent bitmap. A device dependent bitmap may be a form of image data that is stored in a format specific to a display device (e.g. display 192). In an embodiment, browser process 110 may update backing store 194 with a bitmap that it may retrieve from shared memory area 130. In an embodiment, browser process 110 includes a renderview host (not shown) that updates backing store 194 with a bitmap that it may retrieve from shared memory area 130. In an embodiment, the backing store 194 maintains a bitmap representing the current contents of a web-page being displayed on display 192. Because backing store 194 maintains a current bitmap representing contents of a web page being displayed on display 192, browser 110 is able to quickly display the web page, without re-rendering the entire web-page, should the web page need to be re-displayed on display 192. The operation of a renderview host and a backing store is further discussed in detail in U.S. patent application Ser. No. 12/464,643, entitled "Methods and Systems For Rendering in a Browser," which is incorporated by reference herein in its entirety.

In an embodiment, browser process 110 places multimedia content (e.g. video or animation) rendered by plug-in process 190, in shared memory 130. The multimedia content is then directly displayed by browser process 110 on display 192. Any other web page content, that is not rendered by plug-in process 190, is saved as a bitmap in backing store 194. In order to maintain an up-to-date copy of a web page that displays rendered multimedia content in backing store 194, browser process 110 also saves a reference to the rendered multimedia content, that is stored in shared memory 130, on backing store 194. In this way, backing store 194 includes a bitmap of the web page content and also a reference to shared memory 130 containing multimedia content rendered by plug-in process 190.

In this way, for example, when a user has carried out a scrolling operation, or other action that requires the web page to be re-displayed (or re-painted), browser 110 paints both the bitmap stored in backing store 194 as well as the referenced rendered multimedia content stored in shared memory 130. Thus, in an embodiment, backing store 194 may include a bitmap representing web page content and also one or more references to rendered multimedia content (e.g., movie frames).

As a purely illustrative example, consider an interactive movie that is being rendered by a plug-in on a web page. In this exemplary scenario, the movie is being played in a rectangular content area within the web page on display 192. In this case, frames of the movie are stored by the plug-in in shared memory 130. Because the rectangular content area is being updated with different movie frames, browser process 110 generates a reference to each updated frame that is placed in shared memory 130 by the plug-in. These references are then added to backing store 194. In this way, backing store 194 maintains an up-to-date copy of the entire web page that displays the movie.

In an embodiment, backing store 194 maintains a reference to the most recent frame and may drop to the reference to the previous frame stored in backing store 194 when the most recent frame obscures the previous frame. In this way, references to each frame of the movie need not be stored in backing store 194.

It is to be appreciated that any updates (e.g. frames or references to frames) stored in backing store 194, or utilized elsewhere by the embodiments, are not limited to multimedia content and can apply to any other form of content, including, but not limited to, blinking cursors, frequently changing text on a web page, etc.

In an embodiment, where a previously displayed frame continues to be displayed (in entirety or in part) when the next frame is to be displayed, browser process 110 stores (or commits) a bitmap representing the previously displayed frame to backing store 194 and also stores references to each frame (or any updating content item) that are subsequently displayed over the previously displayed frame in backing store 194. In another embodiment, a plurality of previously displayed frames (e.g., 'N' frames) may be committed to backing store 194 by browser process 110. Then, when the most recent frame and a previously displayed frame exactly (or substantially) obscure (or hide) each other, backing store 194 can discard the previously displayed frame that is obscured by the most recent frame. In this way, by committing a frame or content area to backing store 194 when it is not fully obscured by a subsequently displayed frame, embodiments automatically adapt to displaying frequently updated content areas of a web page, regardless of the nature of updates to those content areas (e.g., blinking cursor or movie).

Figure 2:
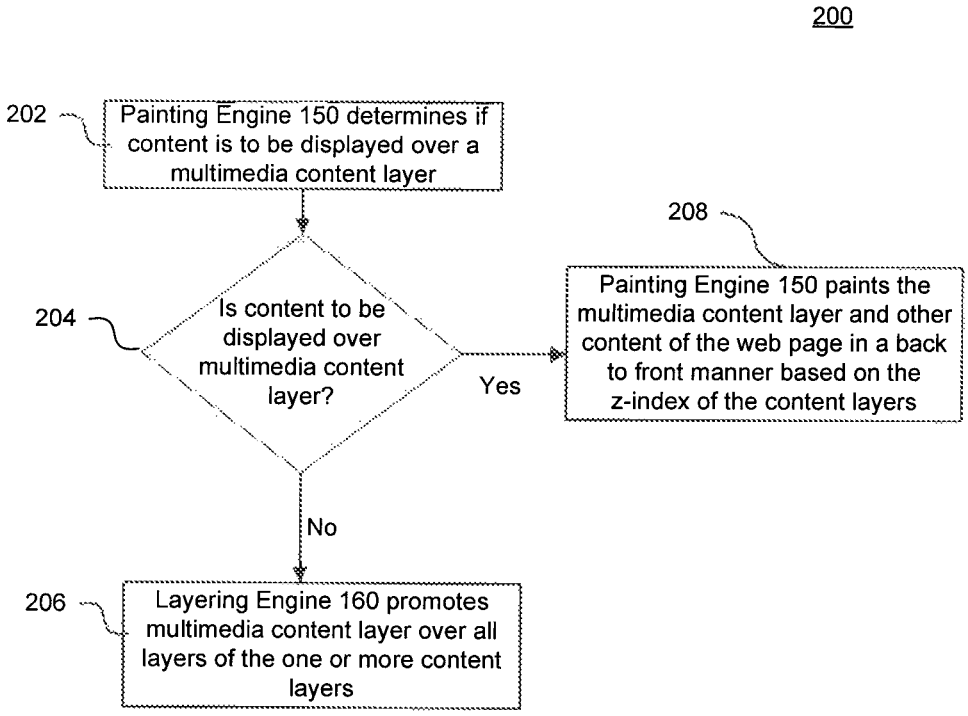
FIG. 2 is a flowchart illustrating a method for optimized rendering of multimedia content, according to an embodiment.

FIG. 2 is a flowchart illustrating method 200 for optimized rendering of multimedia content, according to an embodiment.

Method 200 begins with painting engine 150 determining if content is to be displayed over a multimedia content layer (stage 202). As discussed above, and for example, when painting engine 150 determines that flag 170 is not set, painting engine 150 determines that no content is to be displayed or painted over the multimedia content layer. Conversely, when painting engine 150 determines that flag 170 is set, painting engine 150 determines that content is to be displayed or painted over the multimedia content layer.

If painting engine 150 determines that content is to be displayed over the multimedia content layer (stage 204), painting engine 150 paints contents layers of the web-page that includes the multimedia content layer in a back-to-front manner based on z-index values of the content layers (stage 208). If painting engine 150 determines that content is not to be displayed over the multimedia content layer (stage 204), layering engine 160 promotes the multimedia content layer over all layers of the web page's content layers (stage 208). As discussed above, because the multimedia content layer is promoted for display over all other content layers (e.g., those that include less frequently updated HTML content), content layers below the multimedia content layer are able to render and display quickly with fewer rendering artifacts. This is because if content is rendered over multimedia content (or any other frequently changing content), it requires additional resources to render, and also makes some types of blending (such as sub-pixel text rendering) difficult for the content rendered over the multimedia content. However, because the multimedia content layer is promoted for display over all other content layers, it allows the remaining page content to render with fewer layers (at least one less multimedia content layer) alleviating such concerns.

Figure 3:
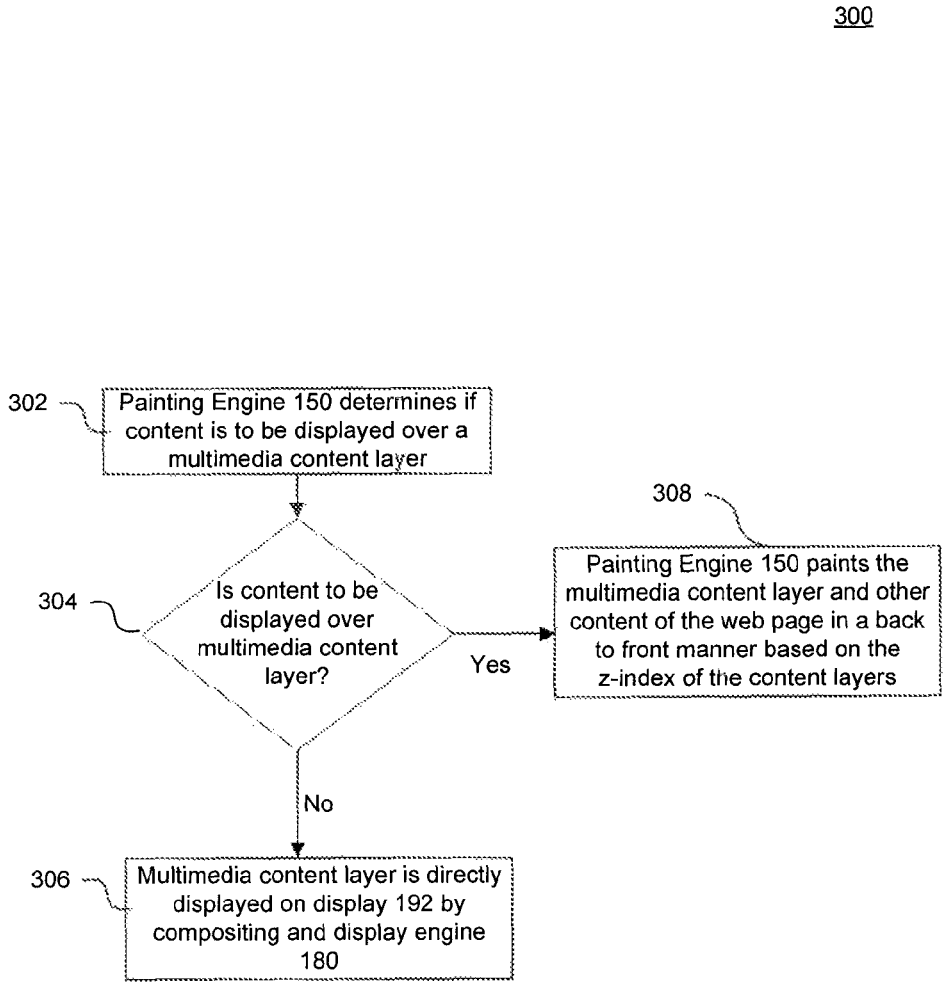
FIG. 3 is a flowchart illustrating a method for optimized rendering of multimedia content, according to another embodiment.

FIG. 3 is a flowchart illustrating method 300 for optimized rendering of multimedia content, according to another embodiment.

Method 300 begins with painting engine 150 determining if content is to be displayed over the multimedia content layer (stage 302). As discussed above, and for example, when painting engine 150 determines that flag 170 is not set, painting engine 150 determines that no content is to be displayed or painted over the multimedia content layer. Conversely, when painting engine 150 determines that flag 170 is set, painting engine 150 determines that content is to be displayed or painted over the multimedia content layer.

If painting engine 150 determines that content is to be displayed over a multimedia content layer (stage 304), painting engine 150 paints contents layers of the web-page that includes the multimedia content layer in a back-to-front manner based on z-index values of the content layers (stage 308). When no content is to be displayed over the multimedia content layer (stage 304), the multimedia content layer (rendered into shared memory 130 by plug-in process 190) is displayed directly on display 192 by compositing and display engine 180 (stage 306). Because the multimedia content layer bitmap can be displayed directly on display 192 from shared memory 130, the remaining content (e.g., less frequently updated HTML content) need not be re-rendered and re-painted along with the multimedia content layer.

Figure 4:
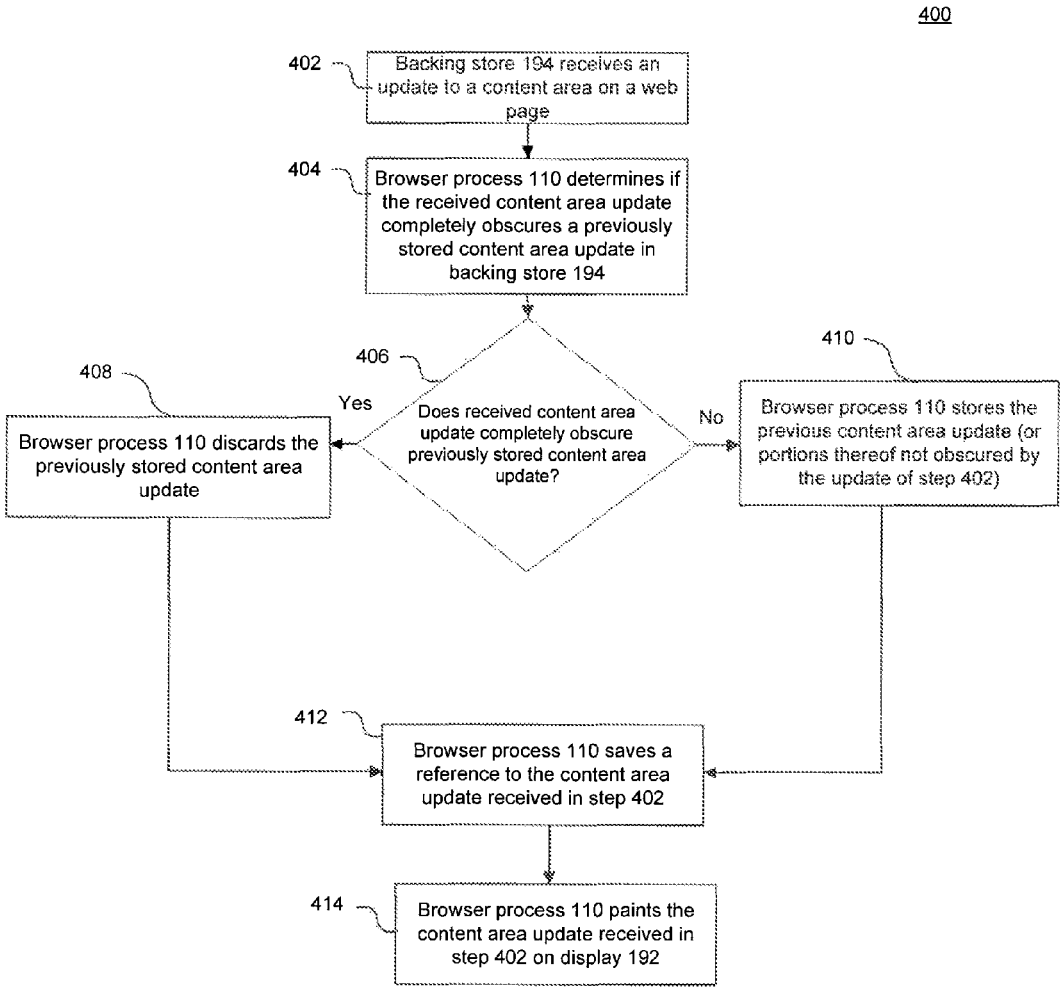
FIG. 4 is a flowchart illustrating an exemplary operation of a backing store, according to an embodiment.

FIG. 4 is a flowchart illustrating method 400, which is an operation of backing store 194, according to an embodiment.

Method 400 begins with backing store 194 receiving an update to a content area in a web page (stage 402). Browser process 110 then determines if the update received in stage 402 completely obscures a previously stored content area update in backing store 194 (stage 404). If the content area update received in stage 402 completely obscures a previously stored content area update (stage 406), browser process 110 discards the previously stored content area update (stage 408) and saves a reference to the content area update received in stage 402 in backing store 194 (stage 412). Browser process 110 also proceeds to paint (or display) the content area update received in stage 402 to display 192 (stage 414). Returning to stage 406, if the content area update received in stage 402 does not completely obscure a previously stored content area update, browser process 110 stores the previous content area update (or portions thereof that are not obscured by the update of stage 402) in backing store 194 (stage 410). Browser process 110 then proceeds to save a reference to the update received in stage 402 in backing store 194 (stage 412) and also proceeds to paint the update received in stage 402 to display 192 (stage 414).

In this way, embodiments enable faster rendering of multimedia content and any other frequently updated content while efficiently utilizing processing resources.

Example Computer Embodiment

Figure 5:
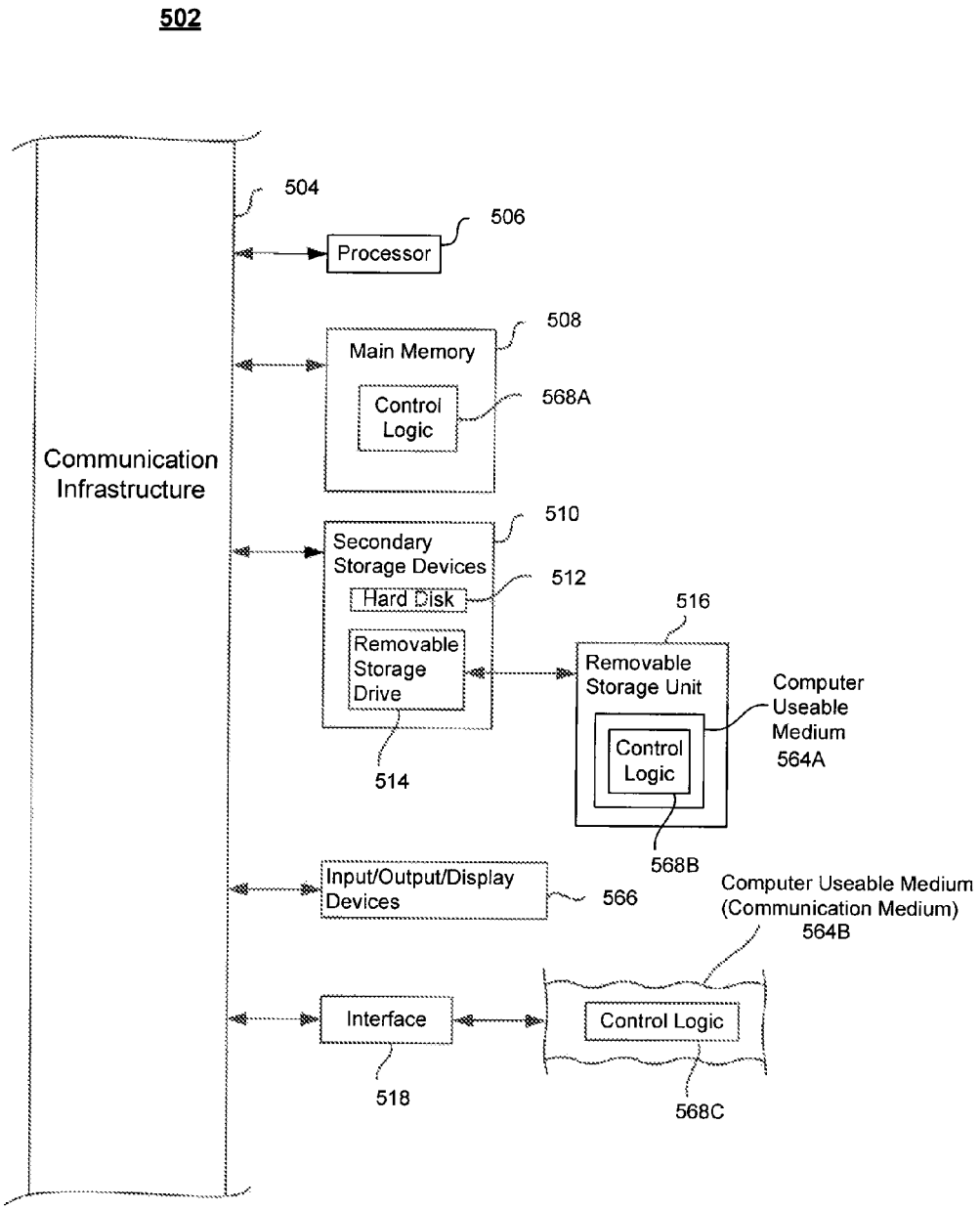
FIG. 5 illustrates an example computer useful for implementing components of the embodiments.

In an embodiment, the system and components of embodiments described herein are implemented using one or more computers, such as example computer 502 shown in FIG. 5. For example, system 100 and system 110 can be implemented using computer(s) 502.

Computer 502 can be any commercially available and well known computer capable of performing the functions described herein, such as computers available from International Business Machines, Apple, Oracle, HP, Dell, Cray, etc.

Computer 502 includes one or more processors (also called central processing units, or CPUs), such as a processor 506. Processor 506 is connected to a communication infrastructure 504.

Computer 502 also includes a main or primary memory 508, such as random access memory (RAM). Primary memory 508 has stored therein control logic 568A (computer software), and data.

Computer 502 also includes one or more secondary storage devices 510. Secondary storage devices 510 include, for example, a hard disk drive 512 and/or a removable storage device or drive 514, as well as other types of storage devices, such as memory cards and memory sticks. Removable storage drive 514 represents a floppy disk drive, a magnetic tape drive, a compact disk drive, an optical storage device, tape backup, etc.

Removable storage drive 514 interacts with a removable storage unit 516. Removable storage unit 516 includes a computer useable or readable storage medium 564A having stored therein computer software 568B (control logic) and/or data. Removable storage unit 516 represents a floppy disk, magnetic tape, compact disk, DVD, optical storage disk, or any other computer data storage device. Removable storage drive 514 reads from and/or writes to removable storage unit 516 in a well-known manner.

Computer 502 also includes input/output/display devices 566, such as monitors, keyboards, pointing devices, Bluetooth devices, etc.

Computer 502 further includes a communication or network interface 518. Network interface 518 enables computer 502 to communicate with remote devices. For example, network interface 518 allows computer 502 to communicate over communication networks or mediums 564B (representing a form of a computer useable or readable medium), such as LANs, WANs, the Internet, etc. Network interface 518 may interface with remote sites or networks via wired or wireless connections.

Control logic 568C may be transmitted to and from computer 502 via communication medium 564B.

Any tangible apparatus or article of manufacture comprising a computer useable or readable medium having control logic (software) stored therein is referred to herein as a computer program product or program storage device. This includes, but is not limited to, computer 502, main memory 508, secondary storage devices 510 and removable storage unit 516. Such computer program products, having control logic stored therein that, when executed by one or more data processing devices, cause such data processing devices to operate as described herein, represent the embodiments.

Embodiments can work with software, hardware, and/or operating system implementations other than those described herein. Any software, hardware, and operating system implementations suitable for performing the functions described herein can be used. Embodiments are applicable to both a client and to a server or a combination of both.

The Summary and Abstract sections may set forth one or more but not all exemplary embodiments as contemplated by the inventor(s), and thus, are not intended to limit the embodiments and the appended claims in any way.

Embodiments have been described above with the aid of functional building blocks illustrating the implementation of specified functions and relationships thereof. The boundaries of these functional building blocks have been arbitrarily defined herein for the convenience of the description. Alternate boundaries can be defined so long as the specified functions and relationships thereof are appropriately performed.

The foregoing description of the specific embodiments will so fully reveal the general nature of the embodiments that others can, by applying knowledge within the skill of the art, readily modify and/or adapt for various applications such specific embodiments, without undue experimentation, without departing from the general concept of the present embodiments. Therefore, such adaptations and modifications are intended, to be within the meaning and range of equivalents of the disclosed embodiments, based on the teaching and guidance presented herein. It is to be understood that the phraseology or terminology herein is for the purpose of description and not of limitation, such that the terminology or phraseology of the present specification is to be interpreted by the skilled artisan in light of the teachings and guidance.

The breadth and scope of the embodiments should not be limited by any of the above-described exemplary embodiments, but should be defined only in accordance with the following claims and their equivalents.

What is claimed is:

1. A computer implemented method for rendering content in one or more content layers in a tab of a browser window, comprising:

identifying one or more content layers for display in the tab of the browser window;

promoting a multimedia content layer for display over all layers of the one or more content layers, when no content is to be displayed over the multimedia content layer, wherein the promoting comprises modifying a z-index attribute associated with the multimedia content layer;

checking opacity of one or more pixels in the multimedia content layer;

blending the one or more pixels with corresponding pixels of the one or more content layers based on the checking; and displaying the multimedia content layer with one or more blended pixels in the tab of the browser window, wherein the identifying, the promoting, the checking, the blending and the displaying are performed using one or more processors.

2. The method of claim 1, further comprising storing the content layers and the promoted multimedia content layer in shared memory.

3. The method of claim 2, further comprising compositing the stored content layers and the multimedia content layer for display.

4. The method of claim 1, further comprising:

determining when the multimedia content layer includes transparent or partially transparent areas;

caching content layers under the transparent or partially transparent areas; and blending the multimedia content layer with the cached content layers.

5. The method of claim 1, further comprising:

determining when the multimedia content layer includes transparent or partially transparent areas;

caching previously blended content layers under the transparent or partially transparent areas; and blending the multimedia content layer with the blended cached content layers.

6. The method of claim 5, further comprising:

caching content areas under the transparent or partially transparent areas for subsequent display.

7. The method of claim 1, further comprising:

checking a first flag to determine if the multimedia content layer is to be displayed over all layers of the one or more content layers; and promoting the multimedia content layer for display over all layers of the one or more content layers based on the checking.

8. The method of claim 7, further comprising:

setting a second flag when content other than multimedia content is painted in a layer above the multimedia content layer, and when the layer completely or partially obscures the multimedia content layer.

9. The method of claim 8, further comprising checking the second flag before promoting the multimedia content layer over all layers of the one or more content layers.

10. The method of claim 1, further comprising:

storing a reference for a presently displayed multimedia content layer frame in a backing store; and replacing the stored reference with another reference associated with a subsequently displayed frame, the replacing performed when the subsequently displayed frame completely or partially obscures the presently displayed frame.

11. A computer-based system for rendering content in one or more content layers in a tab of a browser window, comprising:

one or more processors;

a painting engine configured to identify one or more content layers for display in the tab of the browser window; and a layering engine configured to promote a multimedia content layer for display over all layers of the one or more content layers based on modifying a z-index attribute associated with the multimedia content layer, when no content is to be displayed over the multimedia content layer, and check opacity of one or more pixels in the multimedia content layer; and a compositing and display engine configured to blend the one or more pixels with corresponding pixels of the one or more content layers based on the checking, and display the multimedia content layer with one or more blended pixels, wherein the painting engine, the layering engine, and the compositing and display engine are implemented using the one or more processors.

12. The system of claim 11, further comprising:

a plug-in process configured to render multimedia content.

13. The system of claim 11, further comprising a module configured to check a flag prior to promoting the multimedia content layer over all layers of the one or more content layers.

14. The system of claim 11, further comprising a module configured to determine when the multimedia content layer includes transparent or partially transparent areas.

15. An article of manufacture including a computer-readable medium having instructions stored thereon that, when executed by a computing device, cause the computing device to perform operations comprising:

identifying one or more content layers for display in a tab of a browser window;

promoting a multimedia content layer for display over all layers of the one or more content layers, when no content is to be displayed over the multimedia content layer, wherein the promoting comprises modifying a z-index attribute associated with the multimedia content layer;

checking opacity of one or more pixels in the multimedia content layer;

blending the one or more pixels with corresponding pixels of the one or more content layers based on the checking; and displaying the multimedia content layer with one or more blended pixels in the tab of the browser window.

16. The article of manufacture of claim 15, the operations further comprising storing the content layers and the promoted multimedia content layer in shared memory.

17. The article of manufacture of claim 16, the operations further comprising compositing the stored content layers and the multimedia content layer for display.

18. The article of manufacture of claim 15, the operations further comprising:

determining when the multimedia content layer includes transparent or partially transparent areas;

caching content layers under the transparent or partially transparent areas; and blending the multimedia content layer with the cached content layers.

19. The article of manufacture of claim 15, the operations further comprising:

determining when the multimedia content layer includes transparent or partially transparent areas;

caching previously blended content layers under the transparent or partially transparent areas; and blending the multimedia content layer with the blended cached content layers.

20. The article of manufacture of claim 15, the operations further comprising:

checking a first flag to determine if the multimedia content layer is to be displayed over all layers of the one or more content layers; and promoting the multimedia content layer for display over all layers of the one or more content layers based on the checking.

21. The article of manufacture of claim 15, the operations further comprising:

setting a second flag when content other than multimedia content is painted in a layer above the multimedia content layer, and when the layer completely or partially obscures the multimedia content layer.

22. The article of manufacture of claim 21, the operations further comprising:

checking the second flag before promoting the multimedia content layer over all layers of the one or more content layers.

23. The article of manufacture of claim 15, the operations further comprising:

storing a reference for a presently displayed multimedia content layer frame in a backing store; and replacing the stored reference with another reference associated with a subsequently displayed frame, the replacing performed when the subsequently displayed frame completely or partially obscures the presently displayed frame.

* * * * *